US011833089B2

(12) United States Patent
Dowding

(10) Patent No.: US 11,833,089 B2
(45) Date of Patent: Dec. 5, 2023

(54) SIT-TO-STAND WHEELCHAIR

(71) Applicant: Dowding Tool Products LLC, Springport, MI (US)

(72) Inventor: Maurice H Dowding, Springport, MI (US)

(73) Assignee: Dowding Tool Products LLC, Springport, MI (US)

( * ) Notice: Subject to any disclaimer, the term of this patent is extended or adjusted under 35 U.S.C. 154(b) by 554 days.

(21) Appl. No.: 16/974,162

(22) Filed: Oct. 27, 2020

(65) Prior Publication Data

US 2021/0145675 A1 May 20, 2021

Related U.S. Application Data

(60) Provisional application No. 62/974,216, filed on Nov. 19, 2019.

(51) Int. Cl.

| | |
|---|---|
| ***A61G 5/14*** | (2006.01) |
| ***A61G 5/12*** | (2006.01) |
| ***A61G 5/10*** | (2006.01) |

(52) U.S. Cl.

CPC ..... *A61G 5/14* (2013.01); *A61G 5/104* (2013.01); *A61G 5/128* (2016.11)

(58) Field of Classification Search

CPC ..... A61G 5/14; A61G 5/128; A61G 5/104
USPC ..... 280/657
See application file for complete search history.

(56) References Cited

U.S. PATENT DOCUMENTS

| | | | | |
|---|---|---|---|---|
| 4,054,319 | A * | 10/1977 | Fogg, Jr. | A61G 5/042 297/DIG. 10 |
| 4,587,678 | A * | 5/1986 | Love | A61G 7/1094 297/DIG. 10 |
| 5,772,226 | A * | 6/1998 | Bobichon | A61G 5/14 297/316 |
| 6,641,354 | B1 * | 11/2003 | Lubrano | A61G 5/104 414/921 |
| 7,716,759 | B2 * | 5/2010 | Wilder | A61G 7/1059 5/83.1 |
| 9,101,520 | B2 * | 8/2015 | Goldish | A61G 5/08 |
| 9,173,792 | B2 * | 11/2015 | Goffer | A61G 5/128 |
| 9,333,132 | B2 * | 5/2016 | Bruestle | A61G 5/104 |
| 9,737,448 | B2 * | 8/2017 | Farmer | A61G 5/1035 |
| 10,638,835 | B1 * | 5/2020 | Short | A47B 23/06 |
| 11,173,084 | B2 * | 11/2021 | Dowding | B24B 23/02 |
| 11,246,774 | B2 * | 2/2022 | Lau | A61G 5/14 |
| 11,607,360 | B2 * | 3/2023 | Vatti | A61G 7/1015 |
| 2005/0081294 | A1 * | 4/2005 | Wolters | A61G 13/12 5/613 |
| 2012/0205953 | A1 * | 8/2012 | Bruestle | A61G 5/104 29/525.08 |
| 2013/0020779 | A1 * | 1/2013 | Green | A61G 5/1067 280/200 |

(Continued)

*Primary Examiner* — James A Shriver, II
*Assistant Examiner* — Hilary L Johns
(74) *Attorney, Agent, or Firm* — Honigman LLP; Brett A. Krueger

(57) ABSTRACT

An improved sit-to-stand wheelchair having a base for engaging a surface and carrying a power actuated elevating drive supporting a patient seat and a wheels with improved footrests that may be retractable, said power actuated elevating drive simultaneous elevating the seat and lowering the base into fixed engagement with a surface when the patient desires to move to a standing position.

14 Claims, 5 Drawing Sheets

(56) References Cited

U.S. PATENT DOCUMENTS

| | | | | |
|---|---|---|---|---|
| 2013/0219615 | A1* | 8/2013 | Eklof | A61G 7/1046 5/83.1 |
| 2019/0133856 | A1* | 5/2019 | Dowding | A61G 5/1059 |

* cited by examiner

SIT-TO-STAND WHEELCHAIR

This is a regular, non-provisional U.S. Patent Application which claims the benefit of Provisional Application Ser. No. 62/974,216 entitled SIT-TO-STAND WHEELCHAIR filed by Maurice Dowding on Nov. 19, 2019, the entirety of said Provisional Application is incorporated in this application as if fully set forth herein.

BACKGROUND OF THE INVENTION

Field of Invention

This application is directed to a mobile device for persons with limited ambulatory ability. Such patients present mobility and ambulatory problems to themselves, to hospital and clinic technicians and to the personnel of senior living and assisted care facilities. Such problems include the problem of moving from a bed to a mobile wheelchair and then to an imaging center where they must stand or position themselves on a table for an X-ray, computed tomography scan (CT scan) or a magnetic resonance image (MRI). Similarly, in senior living facilities and assisted living facilities, patients must often be moved from beds to shower facilities and to food service facilities.

These mobility problems are very trying to the patient. In addition, they impose substantial costs upon care providers in that additional personnel must be engaged to assist such patients in their mobility requirements. Too, such mobility problems also impose extra time costs in facilitating such movement.

Description of Related Art

These mobility problems have been previously recognized. Indeed, there have been numerous efforts to provide an acceptable, commercial solution to the problems of ambulatory patients. In general, those efforts have included a wheelchair for mobility combined with a power lift to assist the patient to move from a sitting position in the wheel chair to a standing position. However, such prior devices are illustrated by expensive, complex systems that often included a plurality of linkages, cables, pulleys, etc.

An example of such systems is disclosed in U.S. Pat. No. 7,165,778 which issued on Jan. 23, 2007 on an application of Todd A. Kuiken. That effort to combine a sit-to-stand feature with a wheel chair feature required a plurality of linkages, anti-tip wheels, and a manually operated ratchet drive which manipulates tubes, a pulley and a cable system on each side of the wheel chair.

Another effort to design a wheel chair having a sit-to-stand function is disclosed in U.S. Pat. No. 5,772,226 which issued to Bobichon on Jun. 30, 1998. Again, this effort comprises a substantial number of linkages with an actuator that pivots the seat counterclockwise to assist the patient to move from a sitting to a standing position.

Such efforts to provide a wheelchair with a sit to stand capability also includes a separate lift system using hydraulic or rotary screw drive which can be attached to standard wheelchair. Such is illustrated in U.S. Pat. No. 9,333,132 which issued to Katezlift of Mendota, Mn on May 10, 2016. This separate lift system requires a "universal attachment mechanism" that is adapted to attach to a frame of the wheelchair to raise and lower the wheelchair between an elevated position assisting the patient to stand and a lower mobile position. As shown, the wheelchair does not illustrate footrests usually desired by patients, and if added, would further complicate and interfere with the patient's movement to a standing position.

On belief, none of the prior art developments have resulted in a commercially acceptable mobile wheelchair with a sit-to-stand capability. Those developments appear to lack the desirable low cost, as well as the simplicity, ease of use, strength and/or reliability to be commercially acceptable. In sum and substance, the development of an acceptable, commercial sit-to-stand has been a long felt need.

SUMMARY OF INVENTIONS OF THIS APPLICATION

Contrary to the prior art, the present inventions eliminate the use of numerous plural linkages and pivot points moving through various angles to elevate the patient to a standing position. Instead, the present inventions comprise a low cost, high strength sit-to-stand wheel chair assembly. Their simplicity, strength and low cost is, in part, based on a telescopic power actuator that, of itself, comprises the wheelchair frame so as to avoid the duplication of both a separate frame and a matching, but separate power actuator. Moreover, this simplicity, strength and low cost structure includes a simple, low cost operative movement with a power actuator that is, preferably, encapsulated within the telescopic members.

Simplicity and low cost is further achieved by mounting and/or linking the wheels to the upper telescopic member so as to move the wheelchair from a retracted mobile position in which the wheels support the patient to an extended position in which the wheels are elevated and a solid base is positioned on the surface or ground to enable the patient to move to a standing position with solid support and with confidence. Low costs, simple and/or actuated footrests may be carried by the solid base to provide comfort to the patient without any interference with the patient's movement to the standing position. In part, the inventions herein comprise improvements of the inventions of my prior U.S. patent application Ser. No. 16/350,153 filed Oct. 4, 2018 entitled Sit-To-Stand Wheelchair, the entire contents of which are incorporated in this application as if fully set for the herein.

To achieve the desired simplicity, low costs and strength and to achieve the desired unique functional capabilities, the present inventions are designed to provide one or more of the following advantages and characteristics:

1) a simple design in which an integrated actuator system moves the chair from a wheel supporting position to a fixed, floor supporting position when it is desired to assist the patient to move from a mobile, sitting position to a standing position;
2) a simple low cost design using telescopic tubular members to comprise the frame and to provide substantial strength and rigidity to the unit;
3) a simple low cost design using extendable, telescopic, tubular members preferably formed of plastic to raise and lower the person from a wheel chair sitting position to an elevated sit-to-stand position;
4) a design using guided telescopic members to eliminate the undesirable lateral movement that results from a plurality of pivot points and interconnecting linkages upon elevating a patient;
5) a sit-to-stand wheelchair that eliminates the need for wheel brakes, and provides solid floor surface support for the base of the chair when elevating a patient to a standing position;

6) a sit-to-stand wheelchair that raises the patient to a standing position and simultaneously lowers the entire assembly to a supporting floor to provide a rigid, sturdy foundation for movement;
7) a sit-to-stand wheelchair in which power is supplied in the form of a power actuated screw type linear actuator, that is preferably positioned within the tubular telescopic members which also reduce cost by providing part of the frame of the wheelchair and carry its wheels;
8) a sit-to-stand wheelchair in which the front wheels of the wheelchair are are moved to and from a mobile position by the power actuator that also controls vertical movement of the chair and is provided a fixed, low cost footrests or, that do not interfere with the movement of a patient to a standing position;
9) a sit-to-stand wheelchair that will accept several alternative footrests to more specifically accommodate the needs of non-ambulatory patients and to eliminate the difficulty of rotating and manipulating existing footrests for use by patients;
10) a sit-to-stand wheelchair in which simplified footrests are provided to eliminate the need for an assistant to be available to rotate existing footrests to permit the patient to stand; and
11) an integral, unified mobile lift wheelchair having a low cost, high strength design with a minimum number of parts.

DESCRIPTION OF THE DRAWINGS

The manner in which the foregoing objectives and characteristics are attained is disclosed in the following specification and drawings in which.

DETAIL DESCRIPTION

Figure 1:
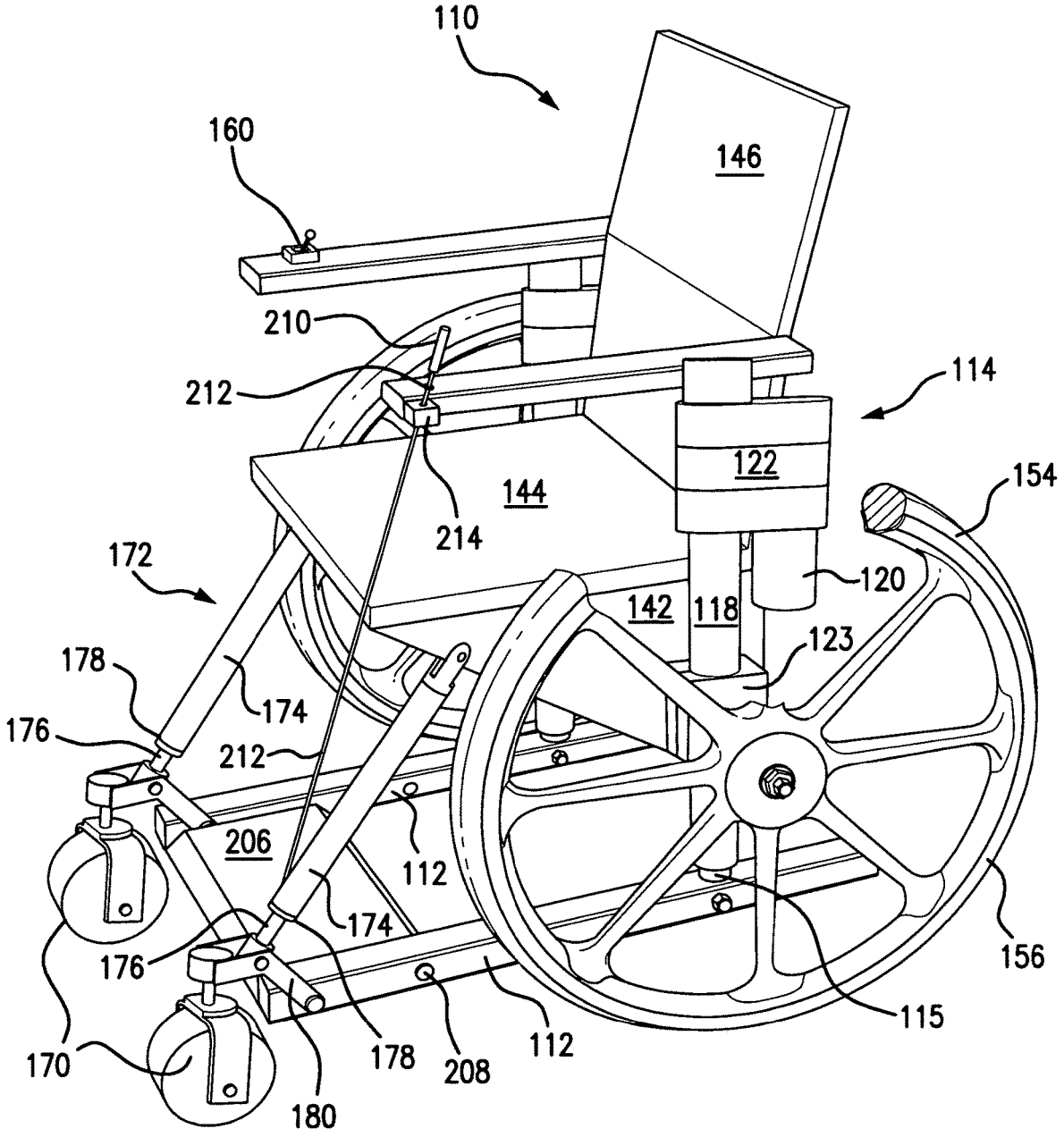
FIG. 1 is a perspective view of a preferred embodiment of the invention depicting the wheelchair and the footrest in the mobile position.

The preferred embodiments of my wheelchair inventions are shown in the drawings identified above. These drawings also illustrate alternative design variations of the present inventive wheelchair species with different footrests. Each design incorporates power actuated telescopic or relative sliding members to provide a stronger, lower cost frame so as to achieve stable movement of the chair from a mobile position to an elevated stationary position in which the patient is elevated to a standing position. In the mobile position, the wheelchair has the normal functions expected of a wheelchair. In the elevated position, the patient is moved vertically upward to further assist his/her exit from the chair and subsequent movement to a standing position. If desired, a tilting feature or a two piece seat as depicted in the prior art may be added to the chair to further assist the patient to move away from the wheelchair into a standing position.

Figure 2:
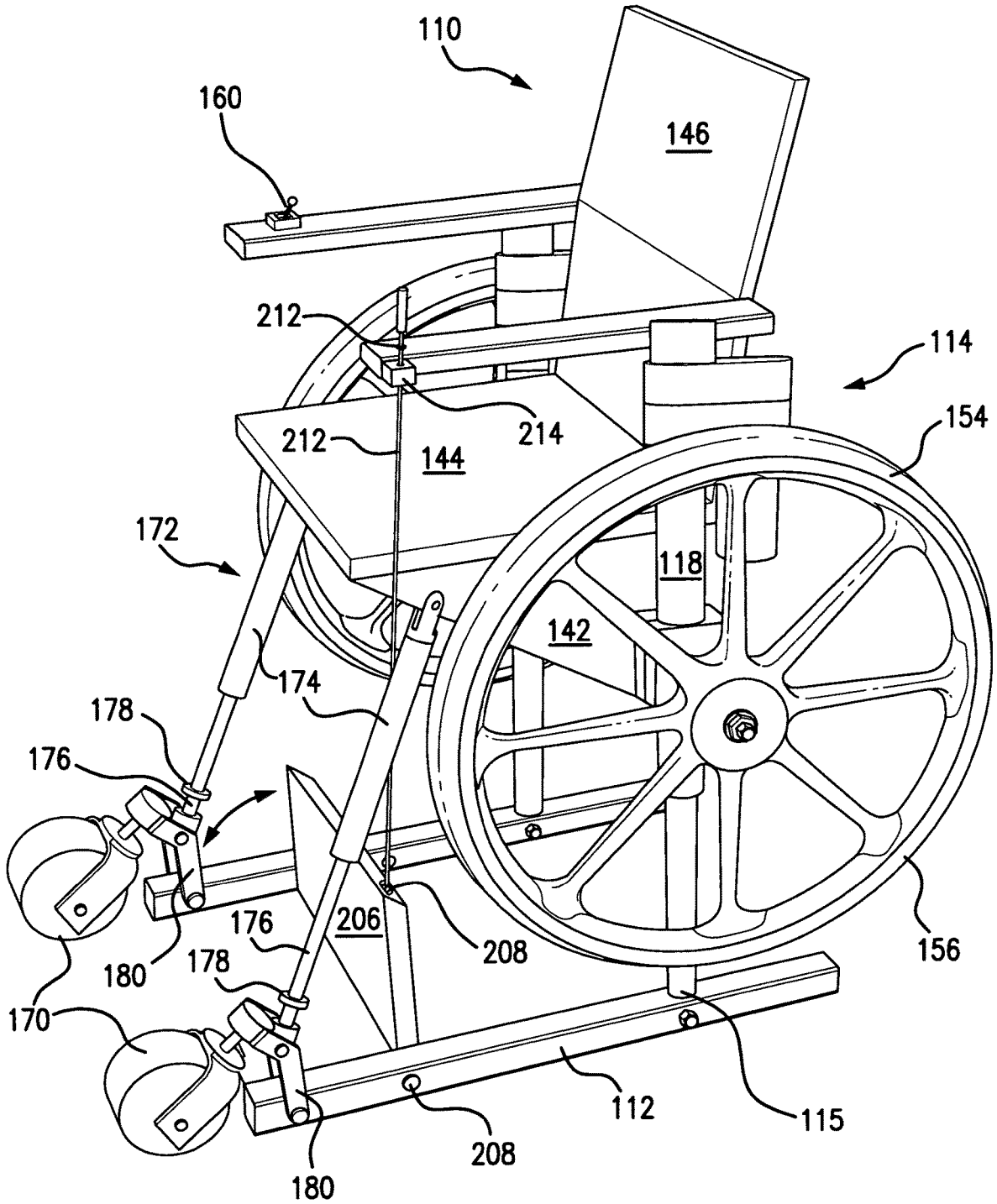
FIG. 2 is a perspective view of a preferred embodiment of the invention depicting the wheelchair in an elevated, stationary position with the wheels elevated above the floor and the elongated base support engaging the floor surface.
Figure 3:
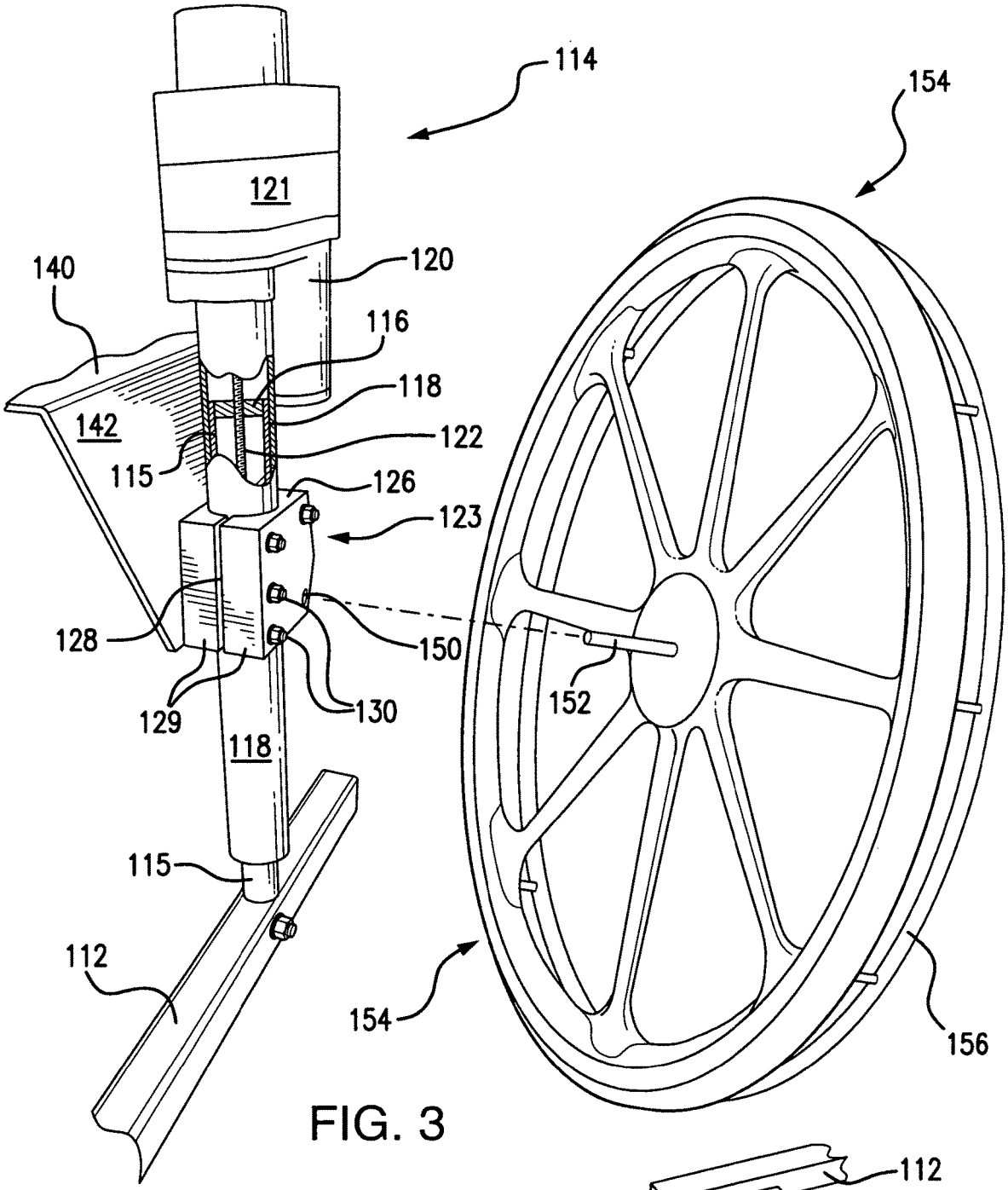
FIG. 3 is an exploded perspective view depicting the frame-screw actuator unit of a preferred embodiment with portions broken away and its association with one of the wheels of the wheelchair.

The first preferred embodiment is depicted in FIGS. 1-3 and 3*a*. In this embodiment, the wheelchair 110 is provided with a base comprised of two spaced apart elongated tubular members 112 positioned inside of each of the large wheels 154. Mounted towards the rear of each of these tubular members 112 is a telescopic screw actuator 114. This actuator 114 has a lower section 115 which is rigidly affixed to the tubular member 112 for supporting the actuator 114 in vertical position as depicted in the drawings. Above the lower section 115 is an upper telescopic cylinder 118 which carries a clamp assembly 123 (best viewed in FIG. 3). Preferably, this clamp assembly 123 is formed of lightweight aluminum and is provided with a bore 126 for receiving the upper telescopic section 118 of the screw actuator 114. The clamp 123 is provided with a slit or cleft 128 which permits the side grip arms or jaws 129 of the assembly 123 to be drawn into a tight, fixed frictional engagement with the upper member 118 by bolts 130. Inside the telescopic cylinders 115 and 118 is a threaded screw 122 which is driven by an electric motor 120 through a set of gears located within the housing 121. Within the upper end of the lower cylinder 115 is a fixed nut 116 which, upon rotation of the screw 122 by the motor 120 causes telescopic or elevational movement of the upper cylinder 118 relative to the lower cylinder 115. As shown in FIG. 3, a bore 150 may be provided in the clamp for receiving an axle 152 of the wheel 154. Bearings and spacers (not shown) may be used to assist rotary motion of the wheels 154 without interference with the nuts 130, which might, alternatively, be countersunk within the clamp assembly 123. Similarly, as shown in FIG. 1, the cushion seat 144 may be provided with depending brackets 142 which may also be fixed to the clamp assembly 123 by the bolts 130.

The screw actuators 114 are commercially available and include, for example, those provided by JWF Technologies of Fairfield, Ohio or Saco-USA Inc. of Rockford Illinois sold under the name "Linear Actuator 808". This actuator provides vertical movement of some 350 mm or approximately 13 inches. Those skilled in the art will find that several suppliers provide similar actuators and selection may well depend upon the desired travel, speed desired and expected weight of the patient. Preferably, the screw actuator 114 can be controlled by a patient with switch 160 which is mounted on the arm rest to control a simple circuit (not shown) with a battery.

Thus, FIGS. 1-3, disclose that upon actuation of the motor 120 of the screw actuator 114 causes the upper cylindrical section 118 to raise or lower the clamp 123 with the wheels 154 and the seat 140. However, to make the wheelchair 110 fully mobile, the front wheels 170 must also be raised as shown in FIG. 1.

This movement of the front wheels 170 can also be accomplished with the power of the screw actuator 114 through a telescopic linkage 172 that is interconnected between the seat 144 or its flanges 142 and the front caster wheels 170. As the actuator 114 lowers the wheelchair 110, the linkage 172 and its cylinder 174 is lowered with the seat 144 to come into contact with an abutment 178 that is mounted on a connecting rod 176 which supports the caster wheels 170. Continued movement of the chair seat 144 downward causes the cylinders 174 to rotate a link 180 counterclockwise about its pivot point on support member 112. As the seat 144 continues downward, the cylinder 174 continues to push the link 180 counterclockwise driving the front wheels 170 to a full supporting position as shown in FIG. 1 and raising the supports 112 into a mobile position.

Reverse or upward movement of the screw actuator 114 will raise the patient towards the standing position and such will also remove the downward force on the castor wheels 170 to permit the elongated supports 112 to firmly engage the ground surface to enable the patient to move to the standing position. If desired, persons skilled in the art will appreciate that engaging abutments on the cylinder 172 and the connecting rod 176 could be used to affirmatively raise the front wheels off the surface. However, without such additions, the rotation of the castor wheels 170 resulting from the removal of pressure will be sufficient to provide the desired stability of the base supports 112 on the floor surface to preclude wheelchair movement while the patient moves from a sitting to a standing position.

As the rear wheels 154 and the front wheels 170 are elevated to move the patient to the standing position, the patient's feet are resting on a footrest 206. It may be desirable to rotate the footrest 206 to a vertical position to enable the patient to stand on directly on the ground surface as the patient moves to a standing position. If so, the footrest 206 may be provided with a pivotable engagement 208 to the elongated supports 112. In addition, a rod 212 may be rotatably connected to the front of the footrest 206 (see FIG. 2) and extended upward to the armrest of the wheelchair to a detent mechanism 214. The patient may grasp the handle 210 on the rod 212 to pivot the footrest upward so that he or she can directly stand on the ground or floor surface.

Figure 3A:
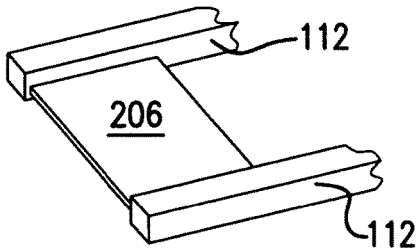
FIG. 3*a* is a perspective view of an alternative, low cost embodiment of a footrest for the wheelchair.

Alternatively, it may be desirable to simplify and fixedly mount a footrest 206 on elongated supports 112 as depicted in FIG. 3*a*. Preferably, such a fixed footrest 206 will be so thin or small that the patient's movement to and from a standing position will not be affected by the small height of that footrest.

Figure 4:
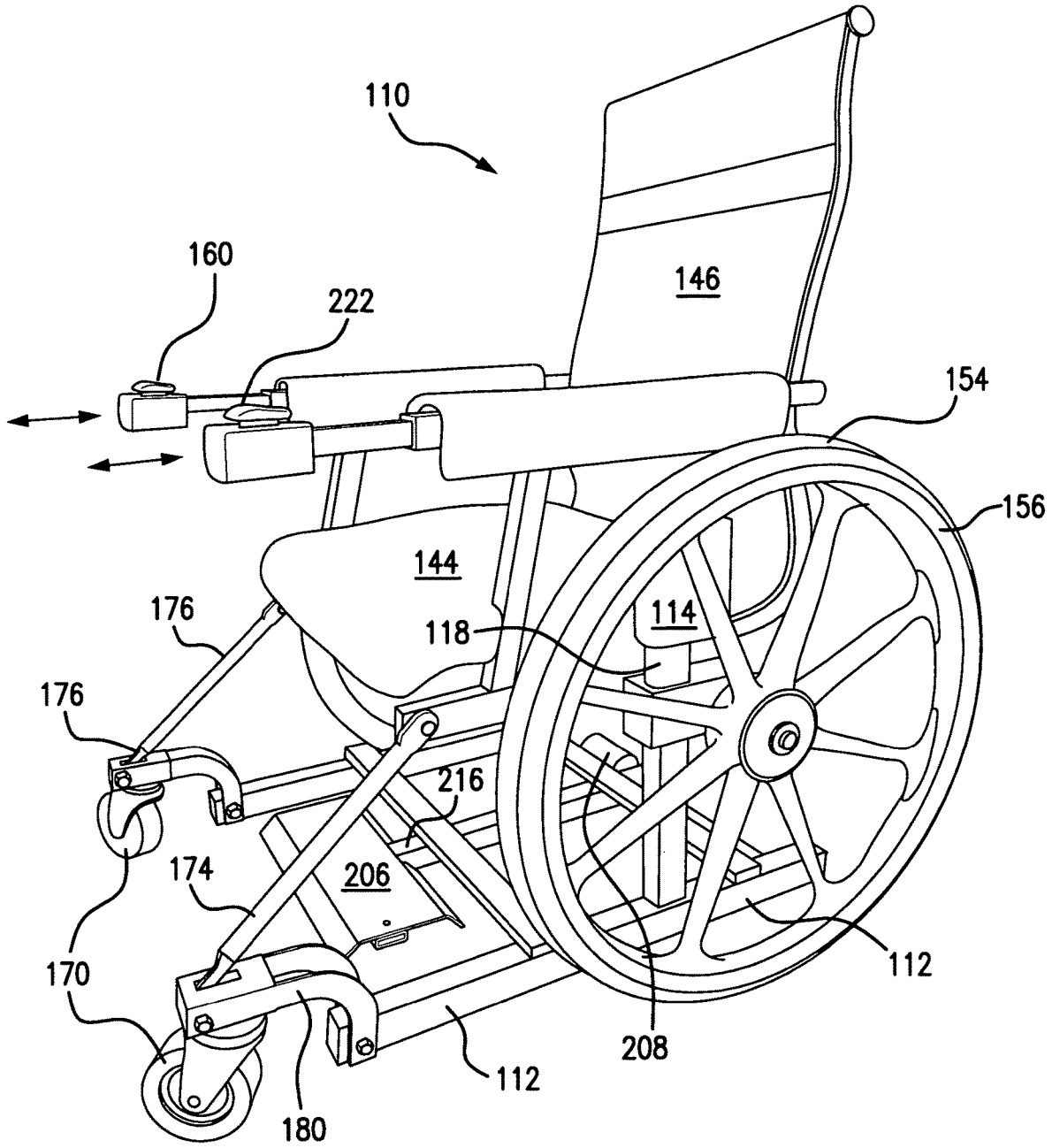
FIG. 4 is a perspective view of the wheelchair in a mobile position supported by the wheels with the addition of a reciprocable footrest.
Figure 5:
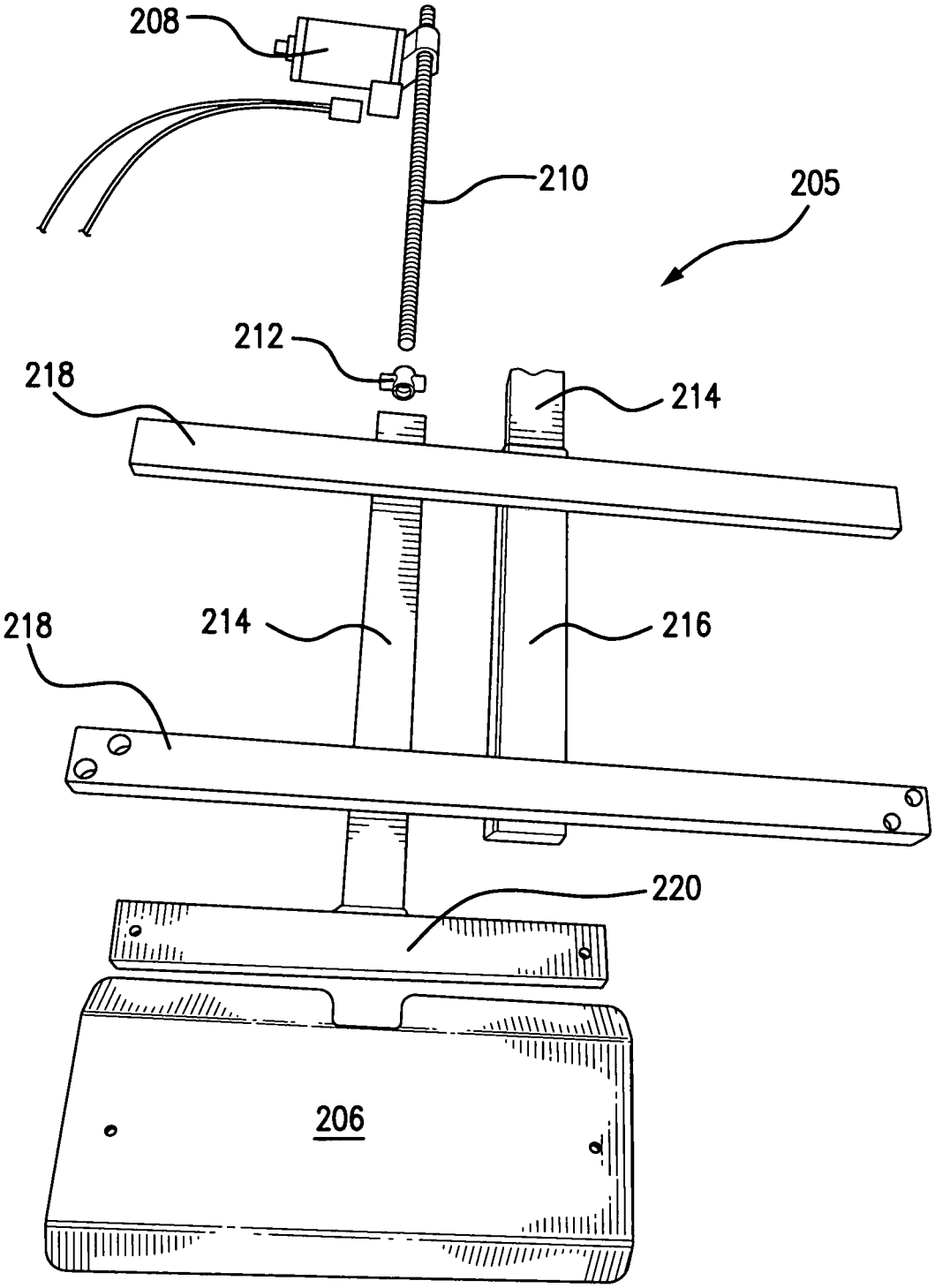
FIG. 5 is an exploded perspective view of a reciprocal footrest for the preferred embodiments of the wheelchair.

FIGS. 4-5 depict another preferred embodiment that is provided with a telescopic footrest assembly 205 having a footrest 206 that is reciprocated back and forth under the wheelchair 110. As shown in FIG. 5, this assembly 205 includes a screw type actuator 208 which may be housed and affixed to the base supports 112 in any conventional manner. The screw drive motor 208 rotates in either clockwise or counterclockwise direction for rotating an elongated screw 210 within a nut 212 that is fixedly mounted in an inner rectangular drive 214. This inner rectangular drive 214 is telescopically mounted within the larger shaped outer tube 216 which is fixed upon the lower surface of the two horizontal cross members 218 that are mounted on the top surface of elongated support members 112. Affixed to the forward end of the inner tubular member 214 is a cross member 220 upon which the footrest plate 206 is physically mounted.

In operation, a switch 222 (FIG. 4) on the armrest can be used by the patient to control the screw type actuator 208 motor to reciprocate the footrest 206 forward for supporting the patient's feet, or, reciprocating the footrest 206 to the rear. Reciprocating the footrest 206 to the rear may be desirable when the wheelchair 110 is raised to enable the patient to move to a standing position.

In the operation of this alternative, the patient, sitting in the wheelchair 110 may actuate the screw actuators 114 to raise the wheelchair to assist the patient in moving to a standing position by actuation of switch 160. Simultaneously, he may also actuate switch 222 to retract the footrest 206 so that the patient can place his feet directly on the floor surface.

Surprisingly, many immobile users may prefer to retract that footrest 206 to become mobile. Indeed, often such users prefer to use their feet to move the wheelchair backward or forward.

Persons skilled in the art will also appreciate that numerous choices can be made regarding wheel sizes, tubular sizes, the extend of movement of the upper telescopic members etc. For this reason, and consistent with the Patent Office rules, the drawings presented herein are not to scale. In addition to changes in sizes, various alternative types of actuators may be used, including, among others, hydraulic actuators, gas spring cylinder actuators (such as those sold under the trademark Bloc-O-Lift) as well as manual actuators. Significantly, those skilled in the art will appreciate that using the linear actuator as the frame will support various modifications and alternatives. As an example, a conventional wheelchair lever type brake may be added to provide a more stationary platform for using the actuator 114 to raise the person to the standing position. Too, persons skilled in art will appreciate the modification of the linkages and the abutment surfaces may be readily changed without departing from the scope of the inventions presented herein. Additionally, and as depicted in FIG. 4, the armrests may be provided with a telescopic extension as patients may find that a longer armrest may enhance their stability and confidence as they move to a standing position. Under these circumstances, those skilled in the art may find it desirable to move the switches 160 and 222 back to the arm rests. The electronic circuit for actuation of the linear actuators may vary depending on numerous safety features such as sensors to limit the height of the movement of the actuators, control boxes that are chosen etc.

I claim:

1. A wheelchair supported by a support surface, the wheelchair comprising:

a seat portion including an armrest rotatable wheels connected to the seat portion for rotatably-supporting the seat portion;

a footrest movement actuator supported by the armrest of the seat portion; and a wheel lift assembly arrangable in one of two orientations including:

a raised orientation whereby the rotatable wheels do not rotatably-engage the support surface; and a lowered orientation whereby the rotatable wheels rotatably-engage the support surface, wherein the wheel lift assembly includes:

a base;

a base movement device that imparts movement of the base relative the support surface for arrangement in one of the raised orientation or the lowered orientation;

a footrest movably-connected to the base, wherein the footrest is connected to the footrest movement actuator, wherein actuation of the footrest movement actuator arranges the footrest in one of two orientations including:

a deployed orientation for at least partially covering the support surface and for supporting feet of a user of the wheelchair when the user of the wheelchair is situated in a seated position upon the seat portion; and a stowed orientation for providing clearance to the support surface for permitting the feet of the user of the wheelchair to engage the support surface when the user of the wheelchair is situated in a standing position away from the seat portion.

2. The wheelchair of claim 1 wherein the base movement device includes:

at least one power actuated member having an upper telescopic section and a lower telescopic section, wherein the lower telescopic section is affixed to the base, wherein the upper telescopic section includes a clamp seat assembly; and a linkage interconnected between the clamp seat assembly and the rotatable wheels.

3. The wheelchair of claim 2, wherein said base includes two spaced apart members, wherein said footrest is pivotally connected to each of said spaced apart members.

4. The wheelchair of claim 2, wherein said footrest is supported by said base and is configured for arrangement under said clamp seat assembly.

5. The wheelchair of claim 4, wherein said footrest is connected to a power unit that induces movement of to reciprocate said footrest from the deployed orientation to the stowed orientation under said clamp seat assembly.

6. The wheelchair of claim 1, wherein the footrest movement actuator is connected to:

a footrest pivoting movement assembly that is supported by the base, wherein the footrest pivoting movement assembly is configured for rotating the footrest for arrangement of the footrest in one of:

the deployed orientation; and the stowed orientation.

7. The wheelchair of claim 6, wherein the deployed orientation includes:

a horizontal arrangement of the footrest substantially parallel to the support surface, wherein the stowed orientation includes:

a vertical arrangement of the footrest substantially perpendicular to the support surface.

8. The wheelchair of claim 6, wherein the footrest movement actuator includes:

a handle extending upwardly and away from the armrest; and a rod including a first end and a second end, wherein the first end of the rod is arranged proximate the armrest and is connected to the handle, wherein a second end of the rod extends downwardly and away from the armrest, wherein the second end of the rod is connected to the footrest.

9. The wheelchair of claim 1, wherein the footrest movement actuator is connected to:

a footrest fore-aft movement assembly that is supported by the base, wherein the footrest fore-aft movement assembly is configured for linearly-moving the footrest for arrangement of the footrest in one of:

the deployed orientation; and the stowed orientation.

10. The wheelchair of claim 9, wherein the deployed orientation includes:

a horizontal arrangement of the footrest substantially parallel to the support surface; and a first arrangement of the footrest forwardly of the seat portion, wherein the stowed orientation includes:

the horizontal arrangement of the footrest substantially perpendicular to the support surface; and a second arrangement of the footrest under the seat portion.

11. The wheelchair of claim 9, wherein the footrest movement actuator includes:

a switch extending from the armrest; and a screw-type actuator arranged proximate the base and communicatively-coupled to the switch.

12. The wheelchair of claim 9, wherein the screw-type actuator includes a motor and a footrest support portion, wherein, responsive to actuation of the switch, the motor is configured for rotation in one of two directions including:

a clockwise direction for rotating a rotatable portion of the footrest support portion in a first direction for arranging the footrest in one of:

the deployed orientation; or the stowed orientation; and a counter-clockwise direction for rotating the rotatable portion of the footrest support portion in a second direction opposite the first direction for arranging the footrest in the other of:

the deployed orientation; or the stowed orientation.

13. The wheelchair of claim 12, wherein the rotatable portion of the footrest support portion includes an elongated screw including a first end and a second end, wherein the first end of the elongated screw is connected to the screw-type actuator and arranged proximate the base, wherein a second end of the elongated screw is arranged proximate the base and is connected to the footrest.

14. The wheelchair of claim 12, wherein the footrest support portion further includes:

a nut;

an inner telescoping member having a proximal end and a distal end, wherein the nut is fixedly mounted to the proximal end of the inner telescoping member;

an outer telescoping member, wherein the inner telescoping member is telescopically mounted within the outer telescoping member;

at least one horizontal cross member supported by the base, wherein the outer tube is fixed upon the at least one horizontal cross member;

wherein the distal end of the inner telescoping member is connected to the footrest.

* * * * *